United States Patent [19]

Lefevre

[11] Patent Number: 4,521,350

[45] Date of Patent: Jun. 4, 1985

[54] DRAINAGE COLLECTION SYSTEM

[75] Inventor: Marcel R. Lefevre, Ft. Myers, Fla.

[73] Assignee: The Munters Corporation, Ft. Myers, Fla.

[21] Appl. No.: 570,758

[22] Filed: Jan. 16, 1984

[51] Int. Cl.[3] ..... B01F 3/04

[52] U.S. Cl. ..... 261/111; 261/DIG. 85

[58] Field of Search ..... 261/DIG. 85, 111

[56] References Cited

U.S. PATENT DOCUMENTS

| | | | |
|---|---|---|---|
| 3,262,682 | 7/1966 | Bredberg | 261/DIG. 11 |
| 4,215,080 | 7/1980 | Ribier et al. | 261/DIG. 85 |
| 4,459,244 | 7/1984 | Norback | 261/DIG. 85 |

FOREIGN PATENT DOCUMENTS

| | | | |
|---|---|---|---|
| 2250776 | 4/1974 | Fed. Rep. of Germany | 261/DIG. 85 |
| 876525 | 8/1942 | France | 261/DIG. 85 |
| 1047454 | 11/1966 | United Kingdom | 261/DIG. 85 |

*Primary Examiner*—Tim Miles

*Attorney, Agent, or Firm*—Curtis, Morris & Safford

[57] ABSTRACT

A drainage collection system for use in an evaporative cooling tower is disposed transversely within a cooling tower below a gas/liquid heat exchanging contact body to receive liquid gravitating therefrom and to collect the same. The drainage collection system includes a plurality of liquid collection plates which are arranged in parallel and inclined from the vertical. Each of the plates includes an upper and a lower end portion with the upper end portion of each overlapping the lower end portion of a respectively adjacent plate. Each plate is shaped over its central portion to form substantially planar upper and lower sections. The lower section is inclined less from the vertical than the upper section. The lower end portion of each of the plates is shaped to form primary and secondary collecting channels extending substantially across the width of the plate for collecting liquid directed thereto by the plate. The primary and secondary collecting channels have outlet ports formed therein for the drainage of liquid collected thereby. The drainage collection system also includes a support frame for the collection plates. The frame includes substantially vertical side supports disposed on corresponding opposite sides of the collection plates. The side supports include lower portions shaped to form troughs disposed below the outlet ports of the primary and secondary collecting channels to receive liquid discharged therethrough.

16 Claims, 7 Drawing Figures

DRAINAGE COLLECTION SYSTEM

BACKGROUND OF THE INVENTION

Field of the Invention

The present invention relates to a liquid collection system for use in an evaporative cooler and in particular relates to a drainage collection system for receiving water gravitating from an air/water heat exchanging contact body located within a cooling tower and disposed above the collection system.

In a conventional cooling tower it is well known to employ a stream of air to cool a liquid, such as water, by contacting the air and liquid in a heat exchanging body located within the cooling tower. Such cooling towers are usually provided with a system for collecting the water falling from the heat exchange contact body.

Conventional liquid collection systems may include a tray or pond which is provided at the base of the tower and into which the water from the contact body falls. Because the heat exchange contact body is usually elevated well above ground level, the water may produce a considerable noise when it impacts the tray or collection pond. Furthermore, a large amount of energy is required to recycle the collected water by pumping it back to a water distribution system disposed above the heat exchange contact body.

The use of intermediate level collection systems have been suggested to reduce the noise and the cost of energy. For example, French Pat. No. 876,525 of Aug. 3, 1942 to Hamon, discloses liquid receiving devices which are positioned immediately below a gas/liquid heat exchanging contact body. The liquid receiving devices include a wall inclined from the vertical and a trough extending along the lower edge of the wall. The devices are arranged in parallel and overhang each other to prevent the liquid from falling from the contact body directly to the base of the cooling tower.

In U.S. Pat. No. 4,215,080, issued July 29, 1980 to Ribier et al., (hereinafter usually the "-080 patent") the patentees describe what they consider to be several disadvantages of the receiving devices disclosed in French Pat. No. 876,525. The specification of the -080 patent contends that liquid droplets which strike against the inclined walls disclosed in French Pat. No. 876,525 may burst upon contact with the walls and produce excessive noise. Also, the droplets splashing on the inclined walls may be deflected laterally beyond the troughs which extend along the lower edges of the walls. Thus, the troughs do not collect all of the water falling onto the inclined walls and the water which splashes from the walls may fall to the collection tray at the base of the cooling tower, creating a further noise problem.

An anti-splash device is disclosed in the -080 patent and is said to overcome some of the disadvantages of the collection devices disclosed in the French Pat. No. 876,525. The -080 patent describes the anti-splash device disclosed in it as being disposed above an inclined wall used for collecting a liquid gravitating from a contact or heat exchange body. The anti-splash device includes a panel for trapping the liquid splashes and it is formed by partitioned walls defining passages which are open at the upper and lower ends and closed in the direction of the greatest slope of the inclined wall. The device is said to be designed so that water gravitating from the contact body can pass through the passages onto the inclined wall, but any water droplets splashing from the wall are blocked by the partition walls of the panel.

The anti-splash device of the -080 patent separate panel disposed above each inclined wall of the system. To accommodate the anti-splash devices, it may be necessary in some applications to increase the separation between the inclined walls of the collection system if the inclined walls are to remain overlapping. This in turn may increase the vertical height of the collection system.

OBJECTS AND SUMMARY OF THE INVENTION

An object of the present invention is to provide a drainage collection system for use in an evaporative cooler which is highly efficient in collecting water.

Another object of the present invention is to provide a drainage collection system which allows air to pass therethrough substantially unimpeded, resulting in a reduced pressure drop across the system.

A further object of the invention is to provide a collection system which takes up relatively little vertical space and which can be supported directly adjacent the underside of a heat exchanging contact body, thereby conserving energy required to pump water collected by the system to a distribution system above the contact body for recycling through the contact body.

It is still a further object of the present invention to provide a drainage collection system which can support the contact body.

It is an additional object of this invention to provide a collection system which reduces the noise level within the cooling tower caused by water gravitating from the contact body.

It is yet an additional object of this invention to describe a drainage collection system which eliminates the anti-splash devices found in prior collection devices.

The drainage collection system of the present invention is most advantageously used in an evaporative cooling tower. The system is disposed within the cooling tower below an air/water heat exchanging contact body to receive and collect water falling from the contact body.

The drainage collection system basically comprises a plurality of water collection plates which are arranged in parallel and inclined to the vertical. Adjacent collection plates define flow through channels for air to pass substantially unimpeded therethrough. The water collection plates include upper and lower end portions with the upper end portion of each overlapping the lower end portion of a respectively adjacent plate. The central portions of the plates are shaped to form substantially planar upper and lower sections. The lower section is inclined less from the vertical than the upper section. The slope and length of each section is selected in accordance with the distance the water must fall from the contact body onto the respective section so that substantially all of the water gravitating from the contact body is not deflected from the surfaces of the collection plates. The lower end portion of each of the plates is shaped to form primary and secondary collecting channels respectively disposed on the upwardly facing and downwardly facing surfaces of the plates and extending substantially across the width of the plates. The water falling onto the plates collects in the primary and secondary channels. The primary and secondary channels include outlet ports formed therein to drain the water collected by the channels.

The drainage collection system also includes a frame for supporting the water collection plates. The frame has substantially vertical side supports disposed on corresponding opposite sides of the collection plates so that the collection plates extend between the side supports. The transverse arrangement of side supports and collection plates provides the collection system with high torsional strength and structural rigidity.

The side supports of the frame include lower portions shaped to form troughs disposed below the outlet ports of the collection plates. Water discharged through the outlet ports of the collection plates is received by the troughs of the side supports. Like the primary and secondary channels of the collection plates, the troughs of the side supports also include outlet ports formed therein which allow the water collected by the troughs to drain into a main water receiving flume.

The above and other objects, features and advantages of this invention will be apparent in the following detailed description of illustrative embodiments thereof, which are to be read in connection with the accompanying drawings.

DETAILED DESCRIPTION OF THE PREFERRED EMBODIMENTS

Figure 1:
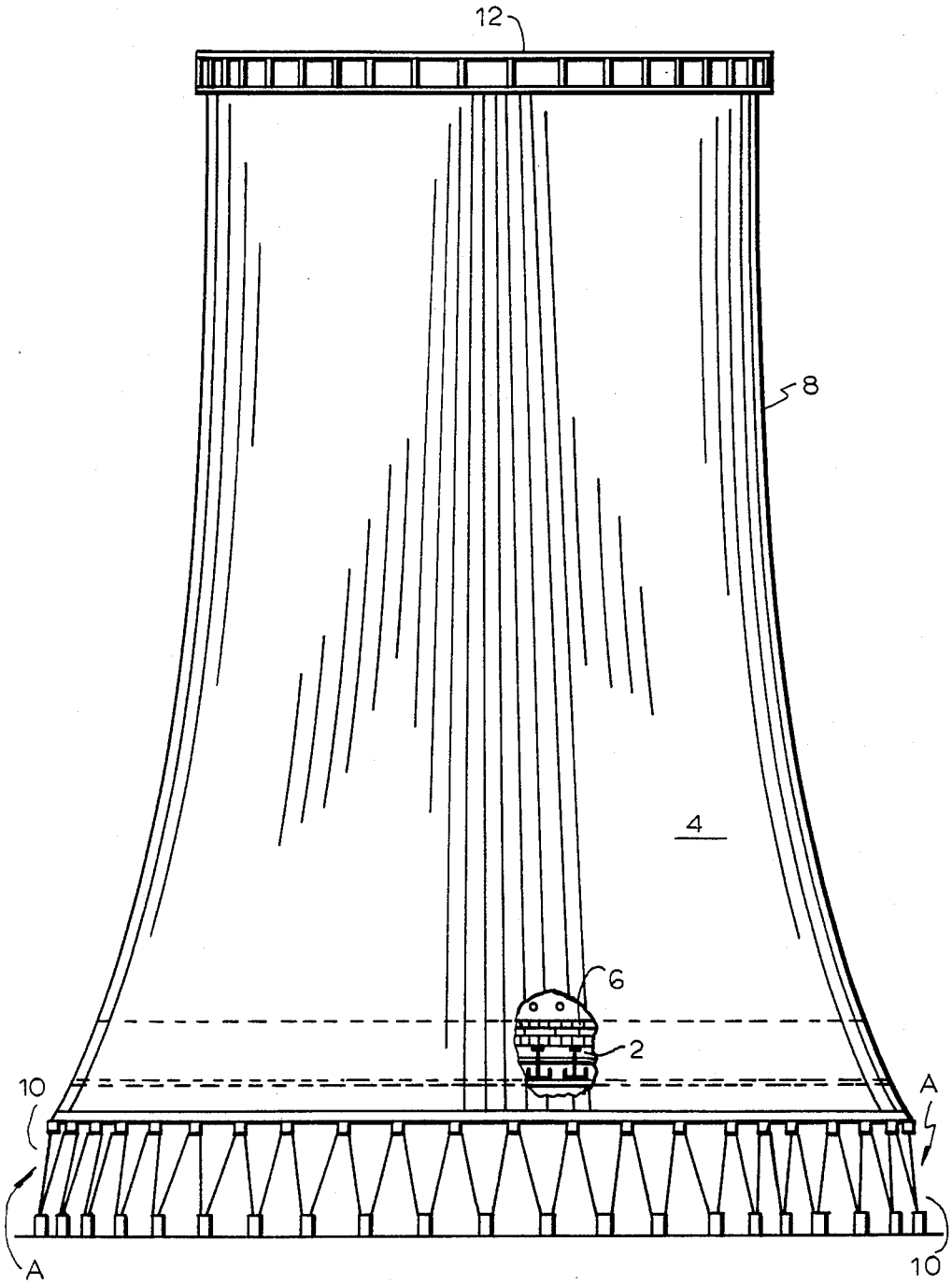
FIG. 1 is an overall environmental view of a cooling tower with its wall partially broken away to expose the drainage collection system of the present invention.

Referring now to the drawings in detail and initially to FIGS. 1 and 2 thereof, it will be seen that an illustrated drainage collection system 2 in accordance with the present invention is disposed within a cooling tower 4 below a gas/liquid heat exchanging contact body 6. Shown in FIG. 1 is a typical natural draft cooling tower 4. The shell 8 of the cooling tower 4 is usually supported above the ground and provides an air entrance port 10 and an air exit port 12. As is well known in the art, the curvature of the shell 8 causes an updraft of air which enters in the direction of arrows A, passes through the components of the heat exchanging system and discharges through the air exit port 12. Although a natural draft cooling tower is shown in FIGS. 1 and 2 of the drawings and described herein, it is envisioned that the drainage collection system of the present invention will work equally as well in a fan forced evaporative cooler.

Figure 2:
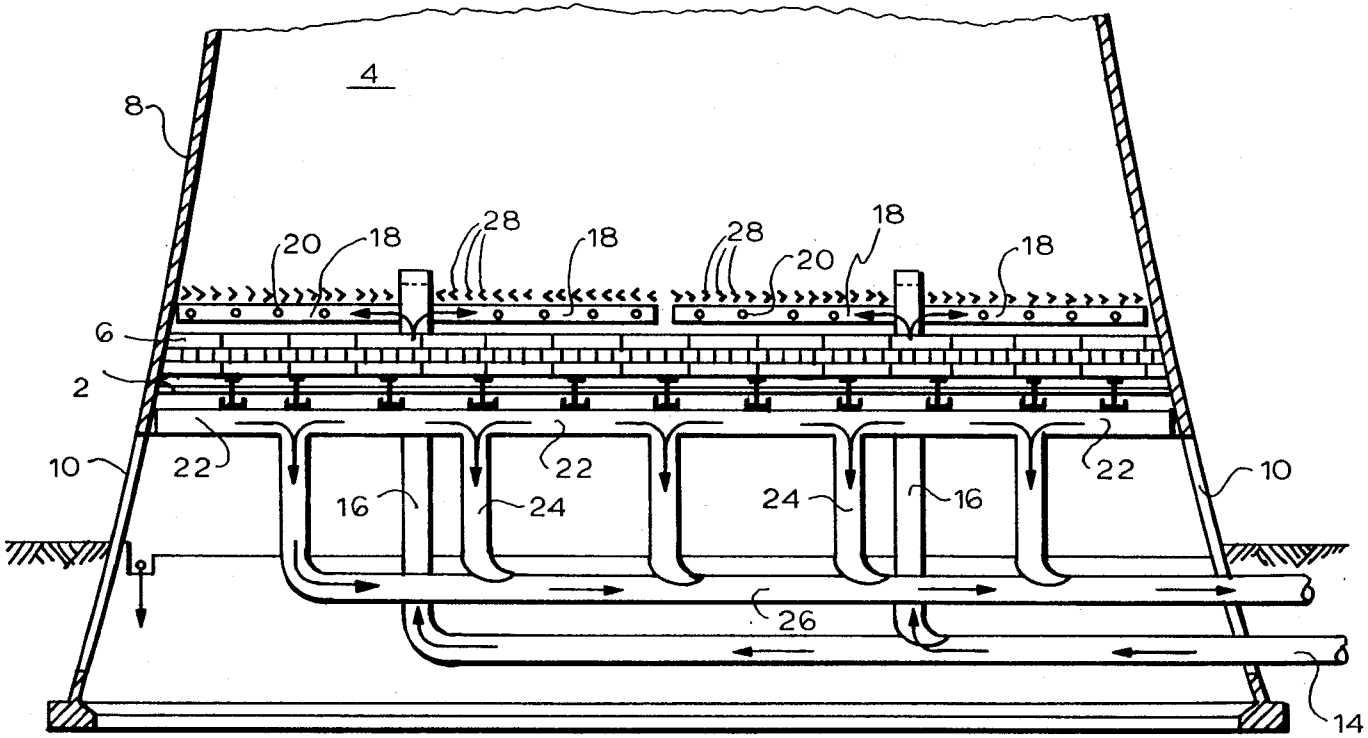
FIG. 2 is a diagrammatic view of the drainage collection system and its placement within the cooling tower with respect to the other components of an evaporative cooling system.

FIG. 1 of the drawings and more particularly FIG. 2 thereof show the placement of the drainage collection system of the present invention in relation to the other components of the heat exchanging system. To facilitate a full understanding of the present invention, the heat exchanging system will at least be summarily described herein.

Liquid to be cooled, such as hot water from an air conditioning system or electric generating plant, for example, flows along a main conduit 14 and branches off into several vertical hot water risers 16. These risers 16 distribute the water to hot water distribution flumes 18 and distribution pipes 20 which extend from the hot water flumes 18. The flumes and pipes make up a hot water distribution system which covers a substantial cross-sectional area of the cooling tower 4. The purpose is, of course, to distribute the hot water over as much area of the cooling tower as possible.

Figure 3:
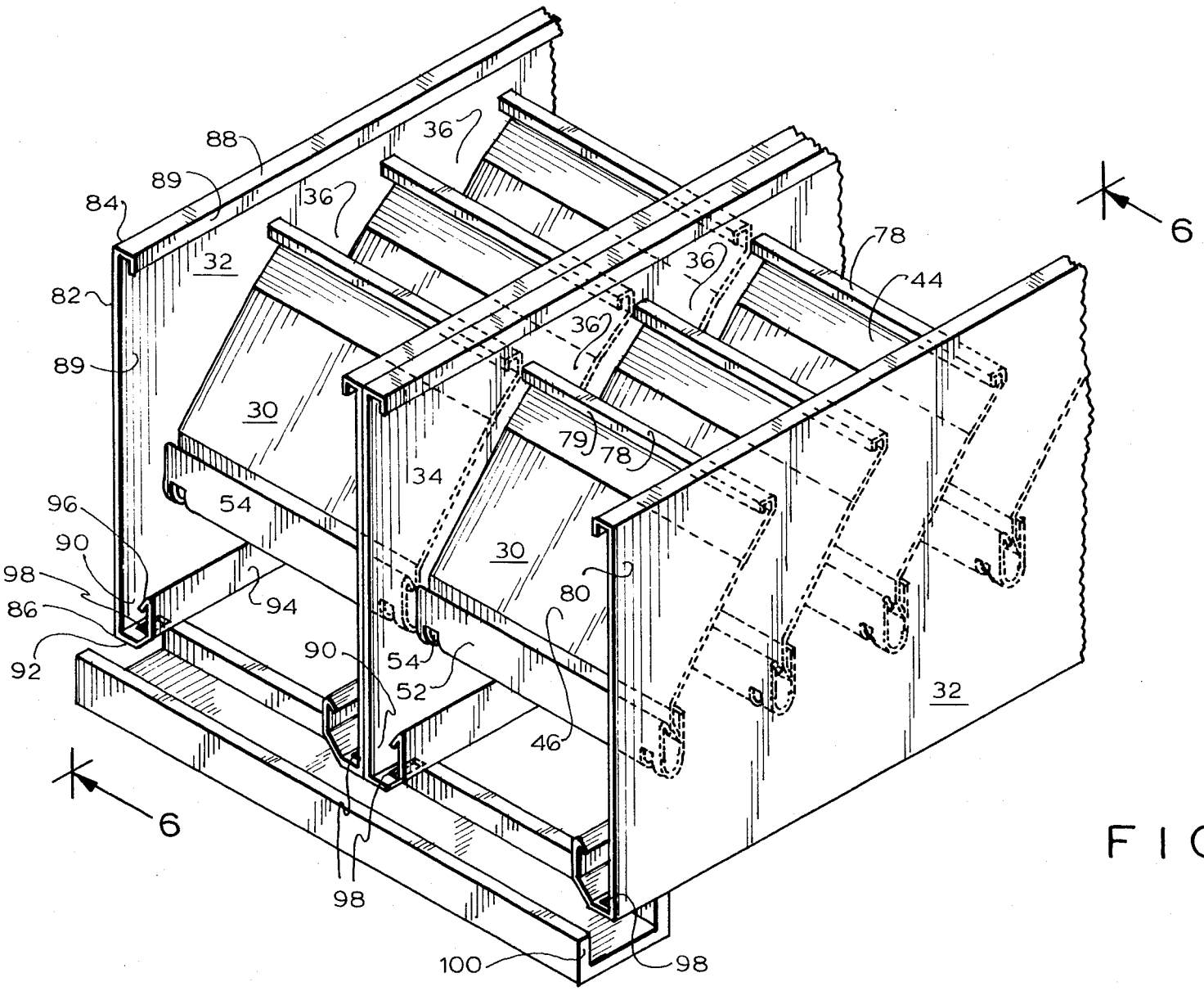
FIG. 3 is a partial perspective view of the drainage collection system of the present invention.

Disposed directly below the hot water distribution flumes and pipes is the gas/liquid heat exchanging contact body 6, commonly referred to as "fill". An example of a contact body suitable for use in the cooling tower 4 is illustrated in FIG. 3 of U.S. Pat. No. 3,262,682 issued on July 26, 1966 to Bredberg. The contact body 6 may comprise several vertical layers of fill, the particular number of layers depending upon the requirements of the system. The contact body 6 may be made of any suitable material such as polyvinyl chloride. The hot water distribution pipes include openings which allow the hot water to gravitate onto the fill where it contacts a gas, such as air, entering through the inlet ports 10 of the cooling tower and passing through the fill. As shown in FIG. 2, the air meets the hot water in a typical counter-flow relationship, that is, the hot water gravitates through the fill in a direction which is opposite to the flow of air, although it is envisioned that the drainage collection system of the present invention will work equally as well in a cross-flow configuration. The contact of the hot water and the air in the fill material causes the thermal exchange of heat from the water to the air. The cooled water gravitates downwardly from the bottom of the fill while the heated air flows upwardly out of the exit port 12 of the cooling tower.

Disposed below the layers of fill is the drainage collection system 2 of the present invention. As mentioned as an object of this invention, the drainage collection system is designed to support the several layers of fill. This simplifies the mechanical complexity of the heat exchanging system. Of course, the fill can be supported or suspended above the drainage collection system by separate means.

As its name implies, the drainage collection system 2 receives and collects the cooled water gravitating from the fill and directs it to several return flumes 22. The return flumes 22 are connected to several vertical branches 24 which feed a main return conduit 26. Although not necessary, the heat exchanging system may include drift eliminators 28 disposed above the water distribution system to prevent water entrained by the flow of air from being swept upwardly with the air out of the outlet port 12 of the cooling tower.

Figure 4:
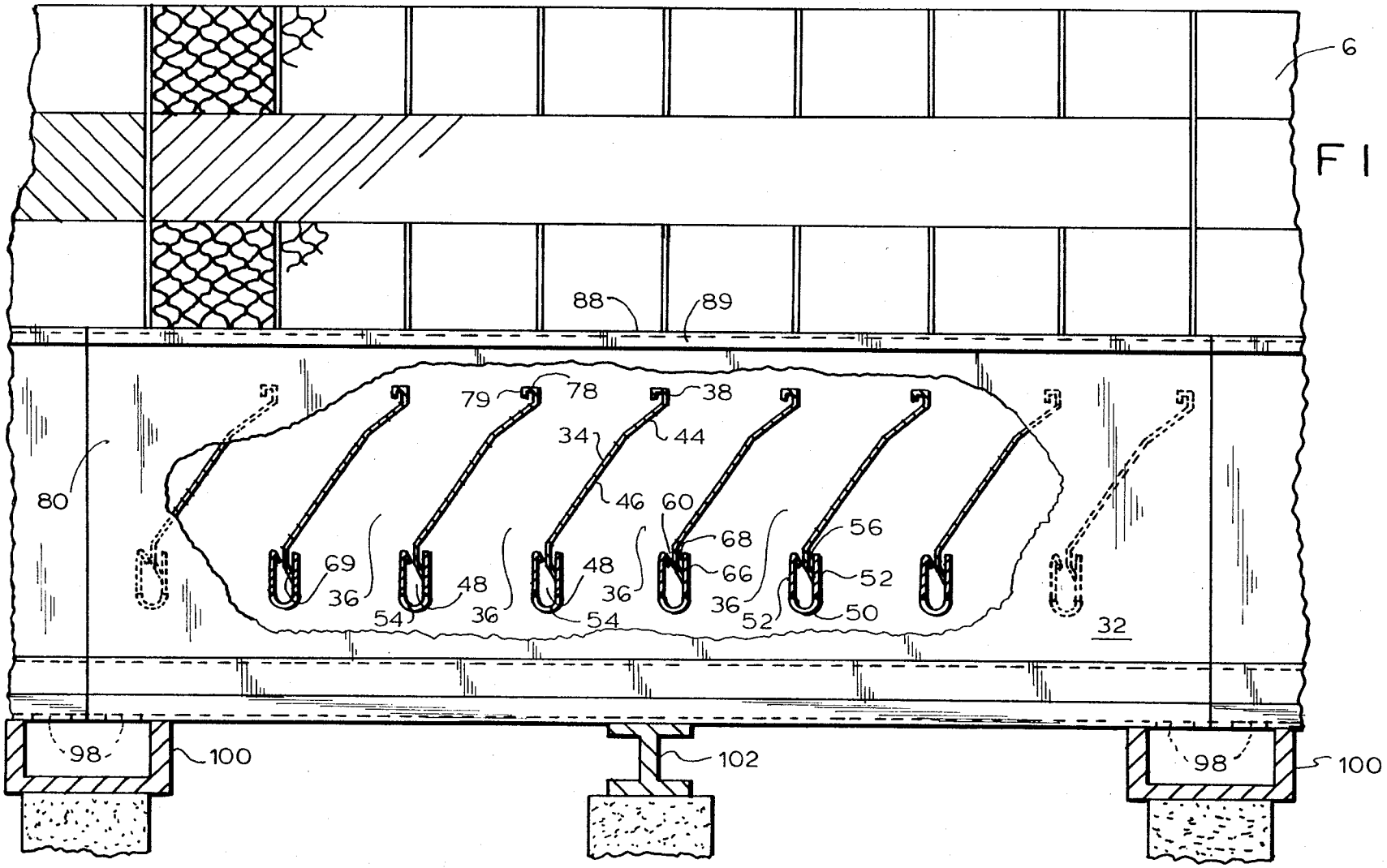
FIG. 4 is a side elevation of the drainage collection system with the frame thereof partially broken away.
Figure 5:
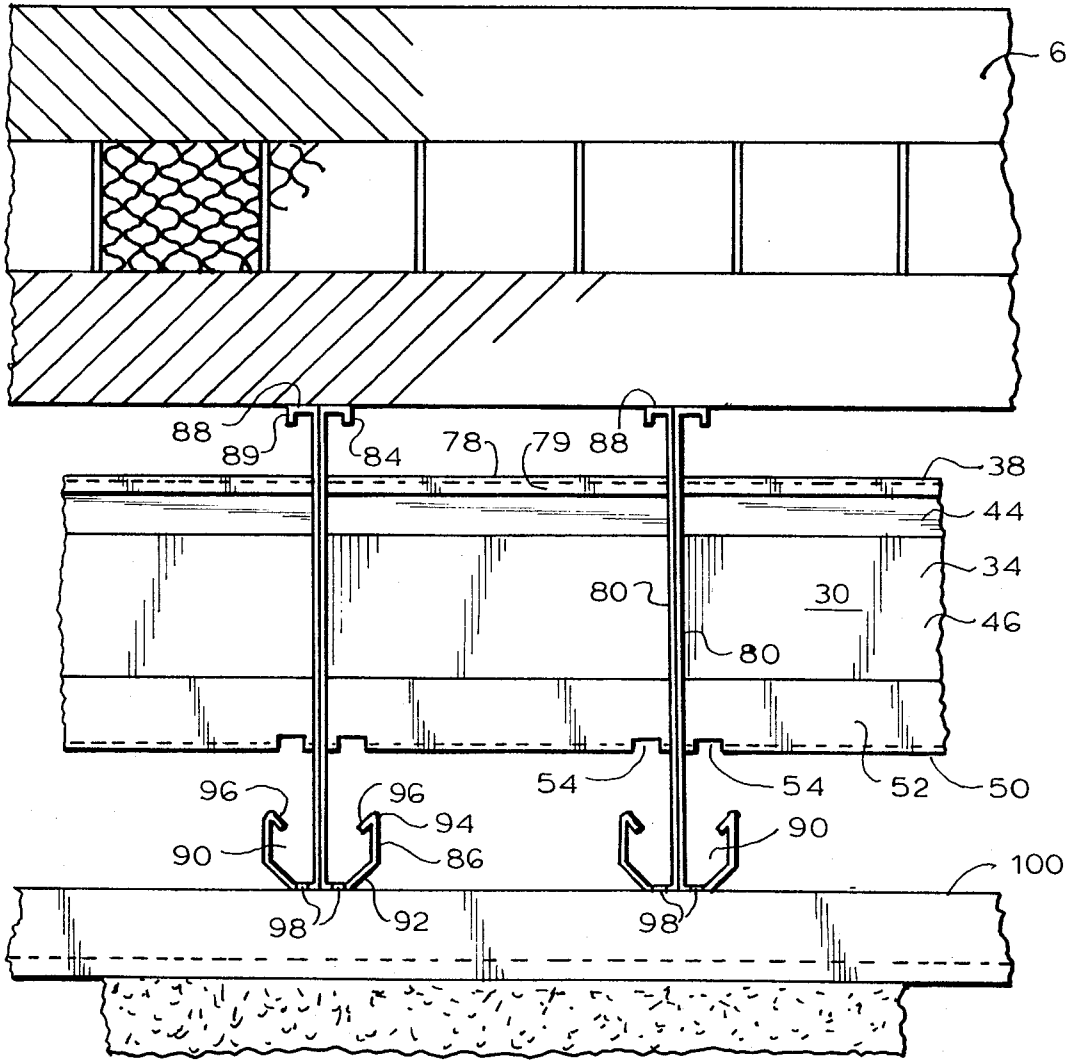
FIG. 5 is a front elevation of the drainage collection system of the present invention.

With reference to FIGS. 3–5 of the drawings, the illustrated drainage collection system of the present invention will now be described in detail.

The drainage collection system basically comprises two main elements—a plurality of liquid collection plates and a supporting frame, generally designated by reference numerals 30 and 32 respectively.

The water collection plates 30 are arranged in parallel and inclined from the vertical so that any water gravitating from the fill disposed above the water collection plates falls onto the upwardly facing surfaces 34 of the plates and is collected thereby.

The parallel arrangement of the water collection plates 30 provides a number of flow through channels 36 for the air. The air flows substantially unimpeded through these channels 36 upwardly into the contact body 6. This is an important feature of the present invention. An impeded air flow will cause a greater pressure drop across the liquid collecting device and will decrease the efficiency of the thermal exchange between the hot water and the air. Thus, it is desirable to keep the pressure drop across the collecting device as low as possible.

Figure 6:
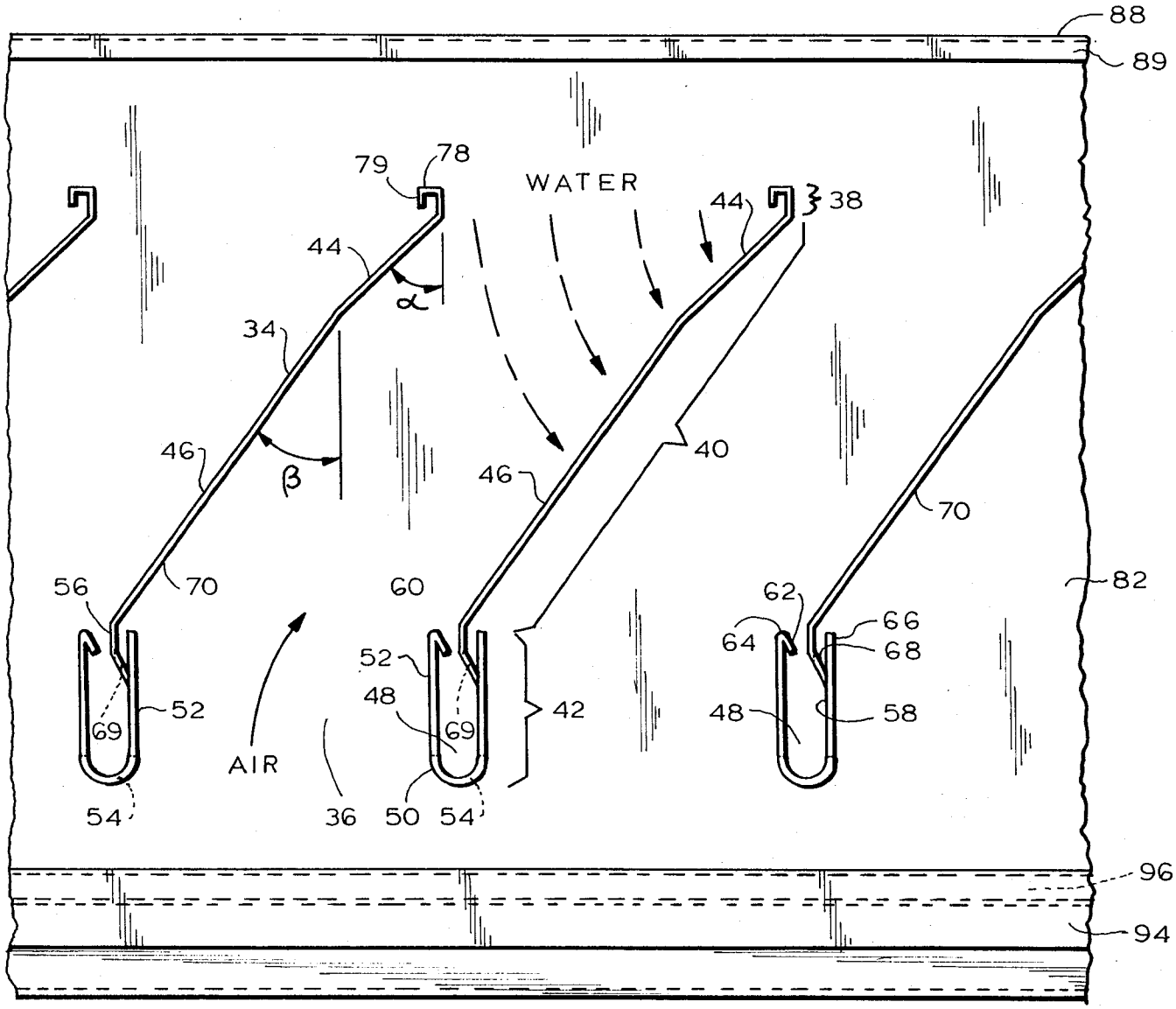
FIG. 6 is a partial sectional view of the liquid collection plates shown in FIG. 3 taken along lines 6—6 of FIG. 3.

FIG. 6 shows in section several water collection plates 30 in accordance with the present invention. The water collection plates generally include an upper end portion 38, a main body portion 40 and a lower end portion 42. All three portions may be integrally formed out of the same material or may be individual components joined together to form the desired shape shown in the drawings.

The upper end portion 38 of each collection plate vertically overlaps the lower end portion 42 of a respectively adjacent plate so that substantially all of the water falling from the fill is collected by the plates.

The main body portion 40 of the plates is shaped to form substantially planar sections each having a different predetermined slope. The slope of at least some of the sections is selected in dependence upon the distance the water falls from the fill onto the sections of the plates 30.

Water falling from a greater height may have sufficient energy to splash from the surfaces of the plates 30. It has been found that splashing can be avoided if the lower sections of the plates, which receive water falling from a greater height, are inclined less from the vertical than the upper sections.

This can be seen with particular reference to FIG. 6 of the drawings. The main body portion 40 of the embodiment shown in FIG. 6 is divided into two sections—an upper section 44 and a lower section 46 with the lower section less inclined from the vertical than the upper section. Water gravitating onto the lower section 46 must fall a greater distance from the contact body 6 than the water which falls onto the upper section 44. Thus, to cause the water to adhere to the lower section 46, it should be inclined from the vertical less than the upper section 44. Any water droplets which may splash from the surface of the upper section will fall onto the lower section and adhere thereto.

The preferred vertical height of the collection plates 30 is 12 inches. The upper section 44 forms an angle $\alpha$ of about 45° with the vertical and extends over approximately the upper 25% of the main body portion 40. It has been found that if the collection plates are 12 inches in vertical height and the contact body 6 is about 4 inches above the uppermost end of the collection plates, the 45° slope will prevent water from splashing from the upper section 44.

Water gravitating onto the lower 75% of the main body portion 40 may have sufficient energy to splash from a 45° sloped surface. For this reason, the lower section 46 is more steeply sloped than the upper section 44 and preferably forms an angle $\beta$ of about 33° with the vertical.

Thus, water falling from the fill is captured by the plates by adhering to the upwardly facing surfaces 34 thereof. The water collected by the plates runs down the sloped sections to the lower end portions 42 where it is collected.

The lower end portion 42 of each plate 30 is shaped to form a primary collecting channel 48. It includes a bottom wall 50, which is preferably rounded, and side walls 52 extending upwardly from the bottom wall 50 so as to resemble an open trough. The primary collecting channel 48 includes discharge ports 54 formed in the opposite end portions thereof to drain the water which collects in the channel 48.

To keep the water received by the primary collecting channel from overflowing or splashing out of the channel 48, it is preferred if the lowermost end of the main body portion 40 of the water collection plate projects partially into the channel and joins the inside surface 58 of one of the side walls 52 of the lower end portion 42. This inwardly projecting portion 56 of the plate defines with the side wall 52 opposite that which is joined to the plate a constricted opening 60 for the channel. This constricted opening helps contain the water in the channel.

It may also be preferable to include a rim 62 which partially extends into the channel from the upper peripheral edge 64 of the side wall 52 opposite that which joins the main body portion 40 of the plate. This rim 62 also prevents water from spilling out of the channel.

The side wall 52 to which the main body portion 40 of the water collecting plate is joined may include an extension 66 of its upper portion. This extension 66 defines with the inwardly projecting portion 56 of the main body portion a secondary collecting channel 68 which is disposed on the downwardly facing surface 70 of the water collection plate 30 and, like the primary collecting channel 48, extends substantially across the width of the plate. The secondary collecting channels also have discharge ports 69 formed in its opposite end portions to drain the water which it receives.

The advantage of including a secondary collecting channel is that many times water droplets may be entrained by the flow of air and are deposited on the downwardly facing surfaces 70 of the collection plates. Because the plates are sloped, the droplets may also run down the downwardly facing surfaces 70 and, if no secondary collecting channel were provided, the droplets would drop off the lower end portions 42 of the plates. It has been found that the secondary collecting channel 68 may account for as much as 2% of the water gravitating from the fill, even with the overlapping arrangement of collection plates. For this reason, its contribution to the efficiency of the collection system is significant.

Figure 7:
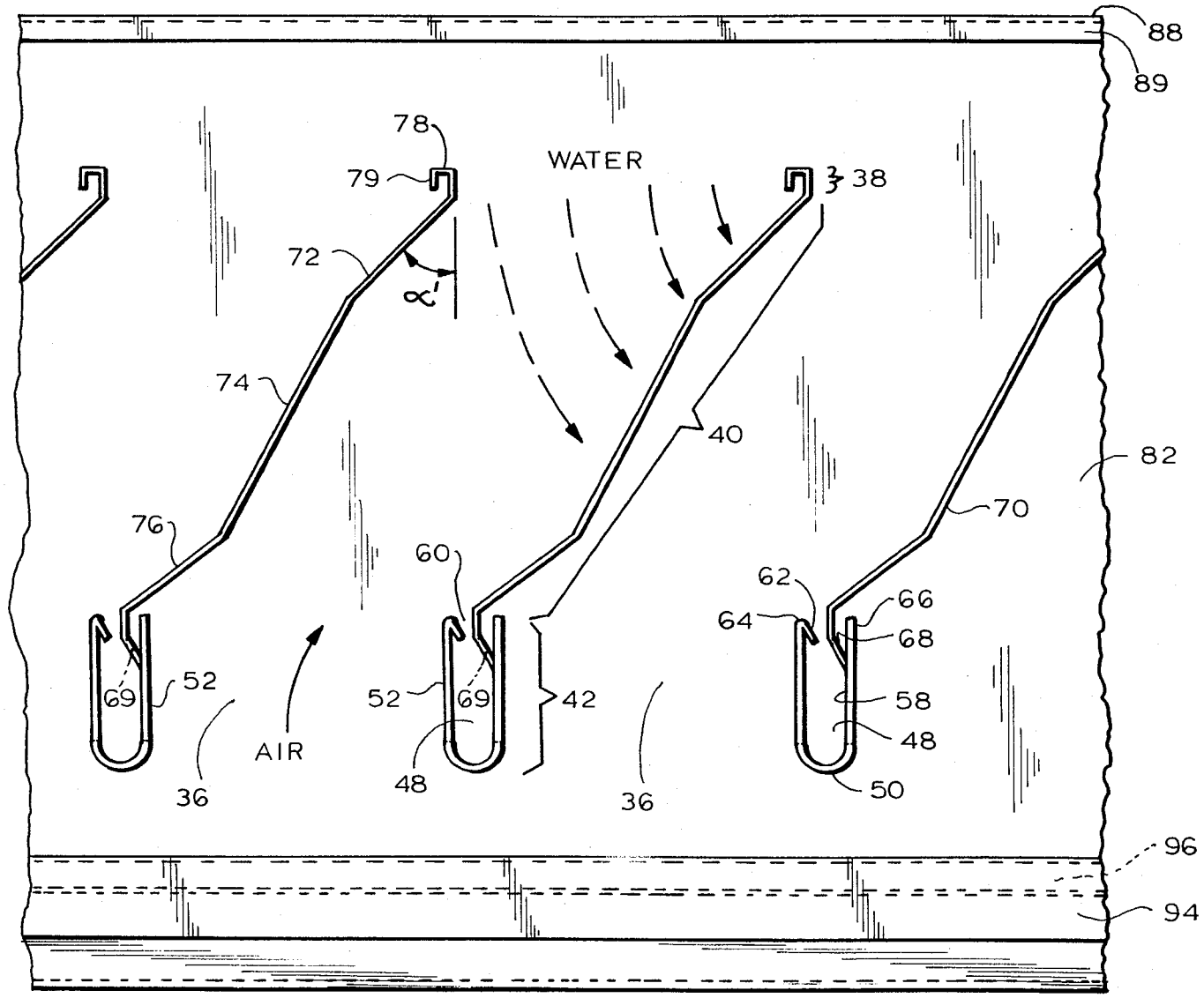
FIG. 7 is a partial sectional view through an alternative embodiment of the collection plates according to the present invention.

With reference to FIG. 7 of the drawings, the collection plates 30 are alternatively provided with a main body portion 40 having three sections. Like the embodiment shown in FIG. 6 of the drawings, a sloped upper section 72 is provided which preferably forms an angle $\alpha'$ of 45° with the vertical and extends over the upper quarter end of the main body portion 40. A middle section 74 is also provided which is preferably less inclined from the vertical than the lower section 46 of the previous embodiment. A lower section 76 is included which may be more inclined from the vertical than the middle section 74. It has been found that the normal flow of air between the collection plates 30 may cause the water droplets gravitating from the fill to be deflected only onto the upper and middle sections 72, 74 of the collection plates. The path which the water droplets follow is represented by the dashed lines shown in FIGS. 6 and 7. Because no water gravitates directly from the fill onto the lower section 76 of the main body portion, it is not necessary that this section be more steeply sloped than the upper and middle sections. The lower section 76 is used primarily to direct the water to flow into the primary collecting channel 48.

The upper end portion 38 of the water collection plates may include a flattened rim 78 and a downturned edge 79. The rim 78 and downturned edge 79 add structural support to the collection plate and to the frame which supports the plates.

As previously mentioned, the drainage collection system of the present invention further includes a frame 32 for supporting the water collection plates 30. The frame includes substantially vertical side supports 80 which are disposed on corresponding opposite sides of the collection plates so that the collection plates extend between the side supports, as shown in FIG. 3 of the drawings.

The side supports 80 include substantially planar central portions 82 and upper and lower portions, 84 and 86 respectively.

The upper portion 84 of the side supports may be shaped to form a flattened rim 88 to support a contact body 6 above the collection plates. The rim 88 may be extended into a downturned edge 89.

The lower portion 86 of the side supports are shaped to form troughs 90 disposed below the outlet ports 54, 69 of the primary and secondary collecting channels of the plates to receive liquid discharged through the outlet ports. Each trough 90 is generally defined by a bottom wall 92 which extends from the central portion 82 of a side support inwardly toward the collection plates and a free standing side wall 94 which extends upwardly from the bottom wall 92.

To prevent water from flowing over the top of the free standing side wall 94, the side wall 94 may include a rim 96 which extends inwardly towards the trough 90 from the upper peripheral edge of the side wall 94. The troughs of the side supports may include outlet ports 98 which allow the water collected in the troughs to drain into a return flume 100.

The drainage collection system of the present invention provides improved means not only to collect the cooled water gravitating from the contact body but also to support the contact body. It may be quite easily and cost effectively manufactured. The collection plates and the side supports may be fabricated from sheet metal or other material or by plastic extrusion or pultrusion. An entire unit of the drainage collection system, i.e., the side supports and the collection plates, may be assembled by welding, soldering, brazing, cementing or gluing the elements of the unit together. By limiting the maximum distance the water falls from the contact body onto the collection plates to approximately 16 inches and the slope of the lower section 46 of the plates shown in FIG. 6 or the middle section 74 of the plates shown in FIG. 7 of the drawings to 40° from the vertical, almost 100% water collection efficiency may be attained. The provision of a secondary collecting channel on the downwardly facing surface of the collection plates ensures that water droplets entrained by the air flow and deposited on the downwardly facing surface are collected.

It is envisioned that the frame of each unit spans a distance of 30 feet and is supported at each end by a water collection flume 100 and in the center by a girder 102. A 15 foot span between supporting members is achieved due to, in part, the structural rigidity provided to the frame by the rim 88 and trough 90 formed respectively in the upper and lower portions of the side supports. As shown in FIGS. 3 and 4 of the drawings, several of the units can be joined lengthwise and widthwise to form a collection system encompassing a substantial cross-sectional area of the cooling tower.

It should be noted here that the transverse disposition of the collection plates with respect to the side supports of the frame maintains the structural integrity of the individual units forming the drainage collection system of the present invention. The transversely disposed collection plates act as cross-braces for the frame. This particular arrangement of plates and side supports provides each unit with greater torsional strength to resist twisting under stress caused by water loading and air flow. The torsional strength of each unit is further enhanced by having the plates extend over a major portion of the height of the side supports and by providing the plates with upturned lower portions, which define the primary collecting channels 48, and downturned upper portions which define the rims 78 and edges 79.

The drainage collection system of the present invention can be easily modified according to the requirements of the evaporative cooling system. For instance, to accommodate an increased water loading, it is merely necessary to include more collection plates in a given unit length, that is, by decreasing the spacing between adjacent collection plates.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of this invention.

What is claimed is:

1. A drainage collection system for use in an evaporative cooling tower, the drainage collection system being disposed transversely across the flow of air within the cooling tower and below a gas/liquid heat exchanging contact body to receive liquid gravitating therefrom and to collect the same, the drainage collection system comprising:

a plurality of liquid collection plates, the collection plates being arranged in parallel and inclined from the vertical, adjacent ones of the collection plates defining therebetween flow through channels for the substantially unimpeded passage of air therethrough, each of the plates having upper and lower end portions with the upper end portion of each overlapping the lower end portion of a respectively adjacent plate, the plates being shaped over a central portion thereof to form substantially planar sections each having a different predetermined slope, the slope of some of the sections being selected in dependence upon the distances between the contact body and the plate sections to enable the plates to receive and collect substantially all of the liquid gravitating from the contact body onto the plates, the lower end portion of each of the plates being shaped to form a primary collecting channel extending substantially across the width of its respective plate for collecting liquid directed thereto by the plate, the primary collecting channels having outlet ports formed therein for the drainage of liquid collected thereby; and a support frame for the collection plates, the frame including substantially vertical side supports disposed on corresponding opposite sides of the collection plates with the collection plates extending between the side supports, the disposition of the plates with respect to the side supports providing the frame with torsional strength, the side supports including lower portions shaped to form troughs disposed below the outlet ports of the collection plates to receive liquid discharged therethrough.

2. A liquid collection plate of a drainage collection system, the drainage collection system being used in an evaporative cooling tower and disposed within the cooling tower below a gas/liquid heat exchanging contact body to receive liquid gravitating therefrom and to collect the same, the liquid collection plate being inclined from the vertical and including an upper end portion and a lower end portion and a main body portion interposed between the upper and lower end portions, the main body portion being shaped to form substantially planar sections each having a different predetermined slope, the slopes of some of the sections being selected in dependence upon the distances between the contact body and the plate sections to enable the collection plate to receive and collect substantially all of the liquid gravitating from the contact body onto the plate, the lower end portion of the collection plate being shaped to form a primary collecting channel and a secondary collecting channel respectively disposed on opposite surfaces of the main body portion, the primary and secondary collecting channels extending substantially across the width of the plate for collecting liquid directed thereto by the plate, the primary and secondary collecting channels having outlet ports formed therein for the drainage of liquid collected thereby.

3. A liquid collection plate as defined in claim 2 wherein the lower end portion includes a bottom wall and side walls extending upwardly from the bottom wall to define the primary collecting channel.

4. A liquid collection plate as defined in claim 3 wherein the lower end of the main body portion is joined to one of the side walls of the lower end portion and projects partially into the primary collecting channel to define with the other side wall a constricted opening.

5. A liquid collection plate as defined in claim 4 wherein the lower end portion further includes an extension of the upper edge of the side wall to which the main body portion is joined, the extension and the lower end of the main body portion defining therebetween the secondary collecting channel.

6. A liquid collection plate as defined in claim 2 wherein the main body portion is shaped to form an upper section and a lower section, the lower section being less inclined from the vertical than the upper section.

7. A liquid collection plate as defined in claim 6 wherein the upper section extends over the upper end quarter portion of the main body portion and is inclined about 45° from the vertical and the lower section is inclined about 33° from the vertical.

8. A liquid collection plate as defined in claim 6 wherein the lower section of the main body portion is inclined at most about 40° from the vertical.

9. A liquid collection plate as defined in claim 2 wherein the main body portion of the plate is shaped to form an upper, a middle and a lower section, the middle section being less inclined from the vertical than the upper section.

10. A liquid collection plate as defined in claim 9 wherein the middle section of the main body portion is inclined at most about 40° from the vertical.

11. A liquid collection plate as defined in claim 2 wherein the upper end portion of the plate includes a flattened rim to add structural support to the plate.

12. A drainage collection system as defined in claim 1 wherein each of the side supports include an upper and a lower portion and a substantially planar center portion, the lower portion of each side support having a bottom wall extending from the center portion and a side wall extending upwardly from the bottom wall whereby the trough of each of the side supports is defined by the side and bottom walls of the lower portion and the center section of the side support.

13. A drainage collection system as defined in claim 12 wherein the upper portion of each of the side supports includes a flattened rim to support the contact body thereabove.

14. A drainage collection system as defined in claim 12 wherein the side wall of the lower portion of each side support includes a rim which partially projects into the trough from the upper peripheral edge of the side wall to inhibit the liquid collected by the trough from flowing over the upper edge of the side wall.

15. A liquid collection plate as defined in claim 4 wherein the side wall opposite that joined to the main body portion includes a rim which partially extends into the primary collecting channel from the upper peripheral edge of the side wall to inhibit the liquid received by the primary collecting channel from flowing over the upper edge of the side wall.

16. A drainage collection system for use in an evaporative cooling tower, the drainage collection system being disposed within the cooling tower below a gas/liquid heat exchanging contact body to receive liquid gravitating therefrom and to collect the same, the drainage collection system comprising:

a plurality of liquid collection plates, the collection plates being arranged in parallel and inclined from the vertical, adjacent ones of the collection plates defining therebetween flow through channels for the substantially unimpeded passage of gas therethrough, each of the plates having upper and lower end portions and a main body portion interposed between the upper and lower end portions, the upper end portion of one of the plates overlapping the lower end portion of a respectively adjacent plate, the main body portion of the plates being shaped to form substantially planar upper and lower sections, the lower section being less inclined from the vertical than the upper section, the slopes of the upper and lower sections being selected in dependence upon the vertical distance between the contact body and the upper and lower sections to enable the plates to receive and collect substantially all of the liquid gravitating from the contact body onto the plates, the lower end portion of each of the plates being shaped to form a primary collecting channel and a secondary collecting channel respectively disposed on an upwardly facing and a downwardly facing surface of the plate and extending substantially across the width of the plate for collecting liquid directed thereto by the plate, the primary and secondary collecting channels of each plate having outlet ports formed therein for the drainage of liquid collected thereby, the outlet ports being situated near opposite ends of the primary and secondary collecting channels, the lower end portion of each plate including a bottom wall and side walls extending upwardly from the bottom wall to define the primary collecting channel, the main body portion of each plate having its lowermost end shaped to project partially into the primary collecting channel and joining one of the side walls of the lower end portion of the plate below the peripheral edge of the side wall to define with the side wall to which it is joined the secondary collecting channel and to define with the other side wall a constricted opening for the primary collecting channel; and a support frame for the liquid collection plates, the frame including substantially vertical side supports disposed on corresponding opposite sides of the collection plates with the collection plates extending between the side supports, the disposition of the plates with respect to the side supports providing the frame with torsional strength, the side supports including upper and lower portions and a substantially planar central portion, the upper portion of each side support including a flattened rim to support the contact body thereabove, the lower portion of each side support including a bottom wall extending inwardly from the center portion toward the collection plates and a free standing side wall extending upwardly from the bottom wall whereby the side and bottom walls and the center section of each side support define a trough disposed below corresponding outlet ports of the collection plates to receive liquid discharged therethrough.

* * * * *